US007264034B2

(12) United States Patent
Lin

(10) Patent No.: US 7,264,034 B2
(45) Date of Patent: Sep. 4, 2007

(54) MOTORIZED BLIND

(76) Inventor: Ke-Min Lin, 18, Tai San 2 St., Fu Quan Li, Jiayi (TW)

( * ) Notice: Subject to any disclaimer, the term of this patent is extended or adjusted under 35 U.S.C. 154(b) by 262 days.

(21) Appl. No.: 11/042,463

(22) Filed: Jan. 25, 2005

(65) Prior Publication Data

US 2006/0162874 A1 Jul. 27, 2006

(51) Int. Cl.
*E06B 9/30* (2006.01)

(52) U.S. Cl. ..... 160/168.1 R; 160/84.02

(58) Field of Classification Search ..... 160/168.1 P, 160/84.02, 176.1 P, 188
See application file for complete search history.

(56) References Cited

U.S. PATENT DOCUMENTS 4,993,469 A * 2/1991 Moench ..... 160/168.1 P
5,517,094 A * 5/1996 Domel et al. ..... 318/254
6,186,211 B1 * 2/2001 Knowles ..... 160/84.02
6,446,693 B1 * 9/2002 Anderson et al. ..... 160/168.1 P
6,789,597 B2 * 9/2004 Wen et al. ..... 160/168.1 P
2004/0123960 A1 * 7/2004 Jorgensen et al. ..... 160/310
2004/0250964 A1 * 12/2004 Carmen et al. ..... 160/120

* cited by examiner

*Primary Examiner*—Peter M. Cuomo
*Assistant Examiner*—Russell Bloodgood
(74) *Attorney, Agent, or Firm*—Alan Kamrath; Kamrath & Associates PA

(57) ABSTRACT

A motorized blind includes a headrail, a bottom rail, a drive shaft, an actuating device, and a power supply device. Thus, the battery of the power supply device is mounted in the bottom rail, so that the battery can be removed from the bottom rail easily and conveniently, thereby facilitating a user replacing or charging the battery of the power supply device when the electric power is not sufficient.

9 Claims, 7 Drawing Sheets

MOTORIZED BLIND

BACKGROUND OF THE INVENTION

1. Field of the Invention

The present invention relates to a motorized blind, and more particularly to a motorized blind that is repaired easily and rapidly.

2. Description of the Related Art

A conventional motorized blind comprises a headrail, a plurality of slats mounted on the headrail, an actuating device mounted on the headrail to lift or lower the slats, and a power supply device mounted on the headrail and electrically connected to the actuating device to supply an electric power to the actuating device to lift or lower the slats. However, the battery of the power supply device is mounted in the headrail, so that the battery cannot be removed from the headrail easily and conveniently, thereby causing inconvenience to a user to replace the battery of the power supply device when the electric power is not sufficient.

SUMMARY OF THE INVENTION

The primary objective of the present invention is to provide a motorized blind that is repaired easily and rapidly.

Another objective of the present invention is to provide a motorized blind, wherein the battery or the chargeable battery of the power supply device is mounted in the bottom rail, so that the battery or the chargeable battery can be removed from the bottom rail easily and conveniently, thereby facilitating a user replacing the battery or charging the chargeable battery of the power supply device when the electric power is not sufficient.

A further objective of the present invention is to provide a motorized blind, wherein both of the power supply device and the actuating device mounted in the bottom rail, thereby facilitating maintenance of the power supply device and the actuating device.

Further benefits and advantages of the present invention will become apparent after a careful reading of the detailed description with appropriate reference to the accompanying drawings.

DETAILED DESCRIPTION OF THE INVENTION

Figure 1:
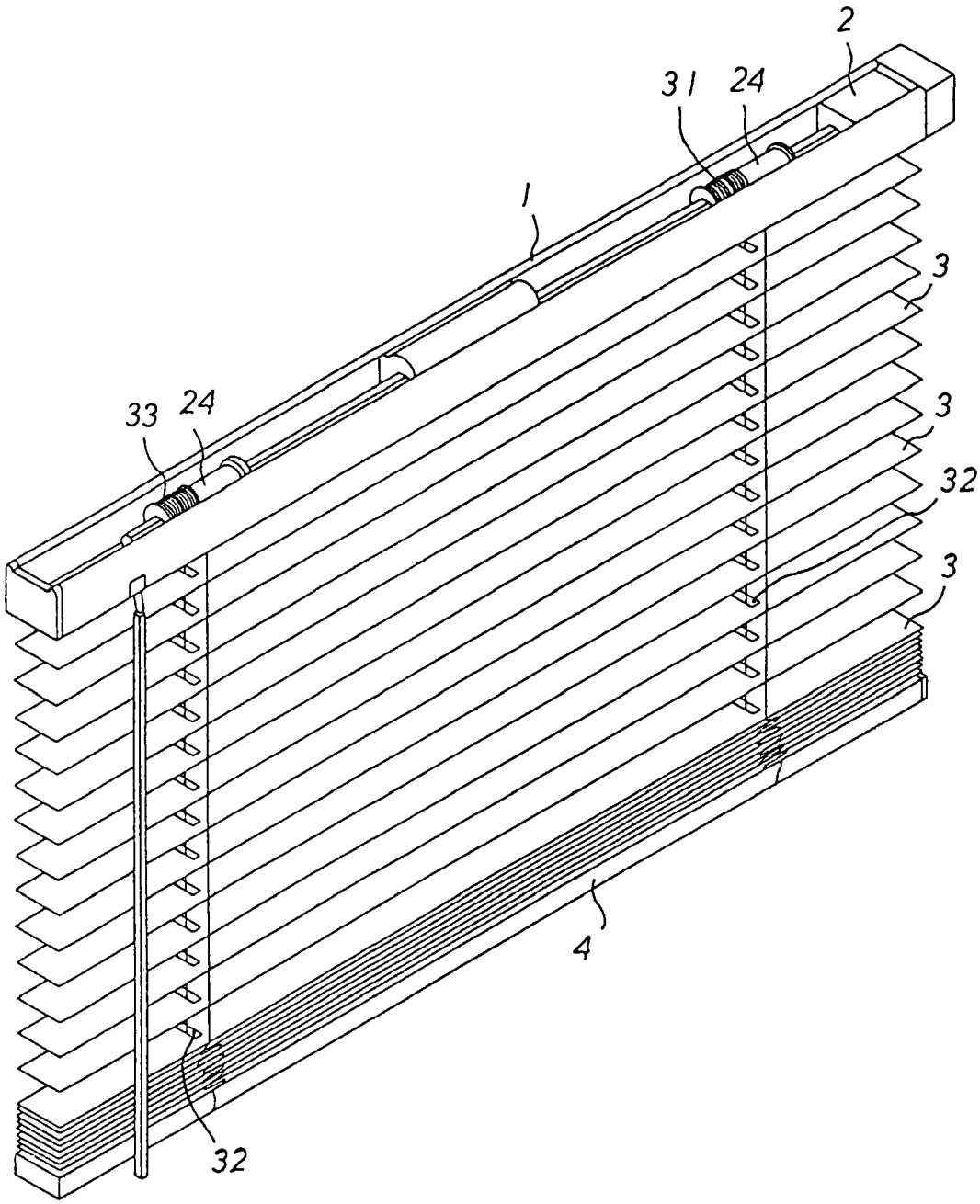
FIG. 1 is a perspective view of a motorized blind in accordance with the preferred embodiment of the present invention.
Figure 2:
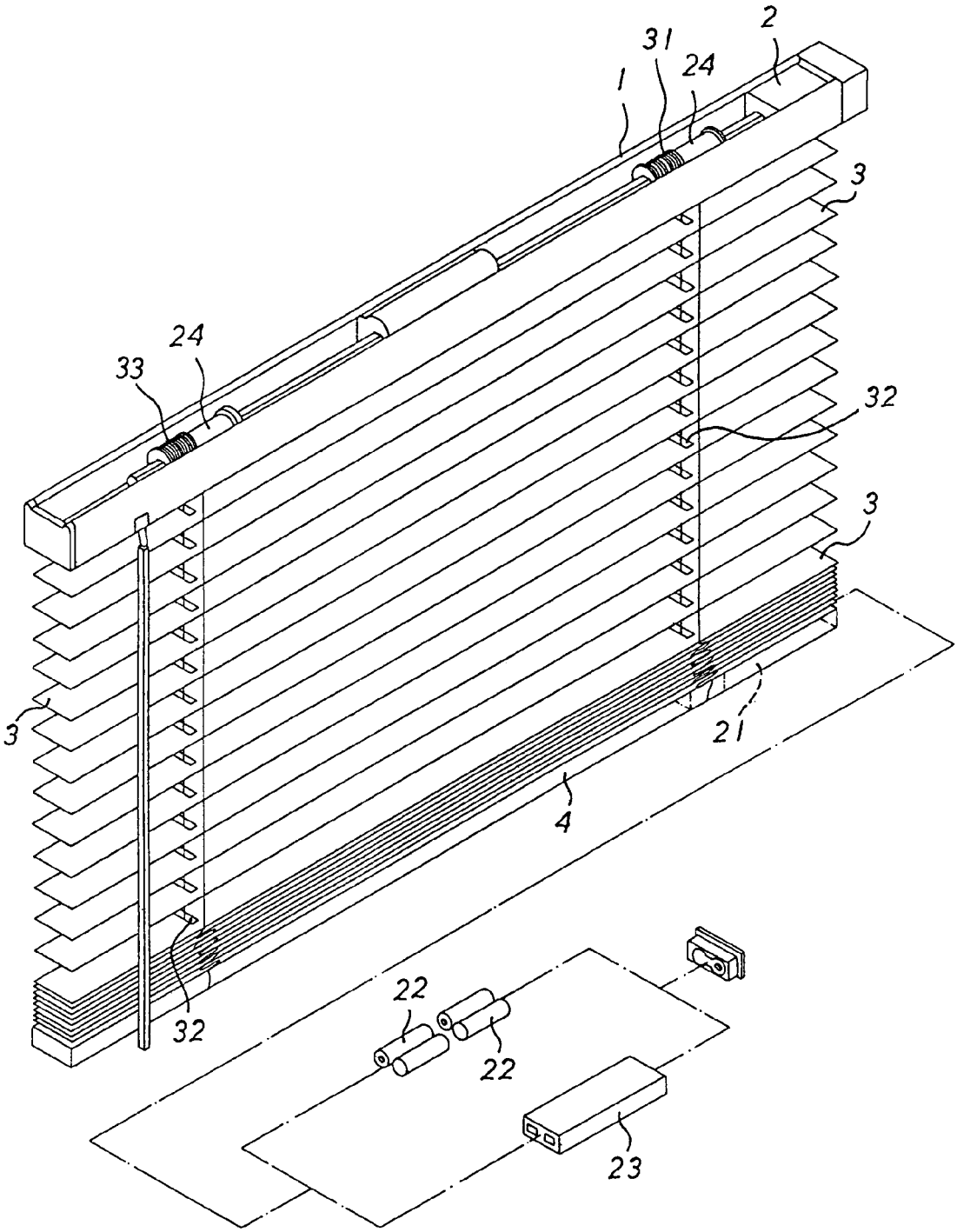
FIG. 2 is a partially exploded perspective view of the motorized blind as shown in FIG. 1.

Referring to the drawings and initially to FIGS. 1 and 2, a motorized blind in accordance with the preferred embodiment of the present invention comprises a headrail 1, a bottom rail 4, a plurality of slats 3 each having a plurality of through holes 32, a drive shaft 24 rotatably mounted in the headrail 1, an actuating device 2 mounted on the headrail 1 to drive the drive shaft 24, and a power supply device mounted on the bottom rail 4 and electrically connected to the actuating device 2 to supply an electric power to the actuating device 2 to drive and rotate the drive shaft 24.

The power supply device includes a battery box 21 mounted in the bottom rail 4 to receive a battery 22 or a chargeable battery 23, and a conducting drive cord 31 having a first end electrically connected to the battery 22 or the chargeable battery 23 and a second end extended through the battery box 21, the respective through hole 32 of each of the slats 3 and the drive shaft 24 and electrically connected to the actuating device 2 to supply the electric power to the actuating device 2.

The motorized blind further comprises at least one lift cord 33 having a first end secured to the bottom rail 4 and a second end extended through the respective through hole 32 of each of the slats 3 and wound around the drive shaft 24, so that the lift cord 33 is moved by rotation of the drive shaft 24 to lift or lower the slats 3.

The second end of the conducting drive cord 31 is wound around the drive shaft 24, so that the conducting drive cord 31 is moved by rotation of the drive shaft 24 to lift or lower the slats 3. Thus, the conducting drive cord 31 co-operates with the lift cord 33 to lift or lower the slats 3. The contacts of the conducting drive cord 31 and the actuating device 2 adopts the type of the rotor and the electric brush.

Figure 3:
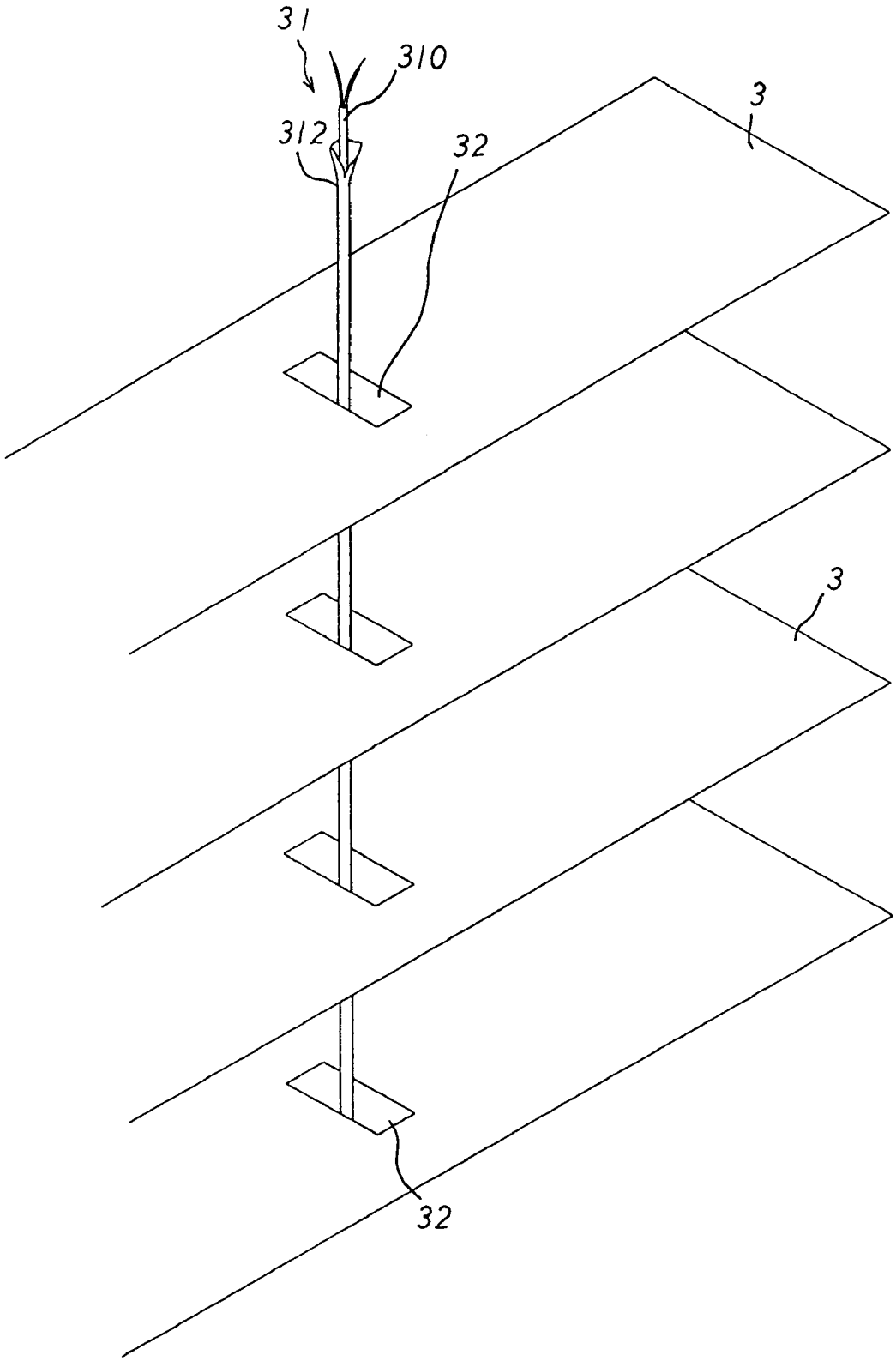
FIG. 3 is a partially perspective enlarged view of the motorized blind as shown in FIG. 1.

As shown in FIG. 3, the conducting drive cord 31 includes a drive wire 312 wound around the drive shaft 24, and a conducting wire 310 mounted in the drive wire 312 and electrically connected to the actuating device 2.

Figure 3A:
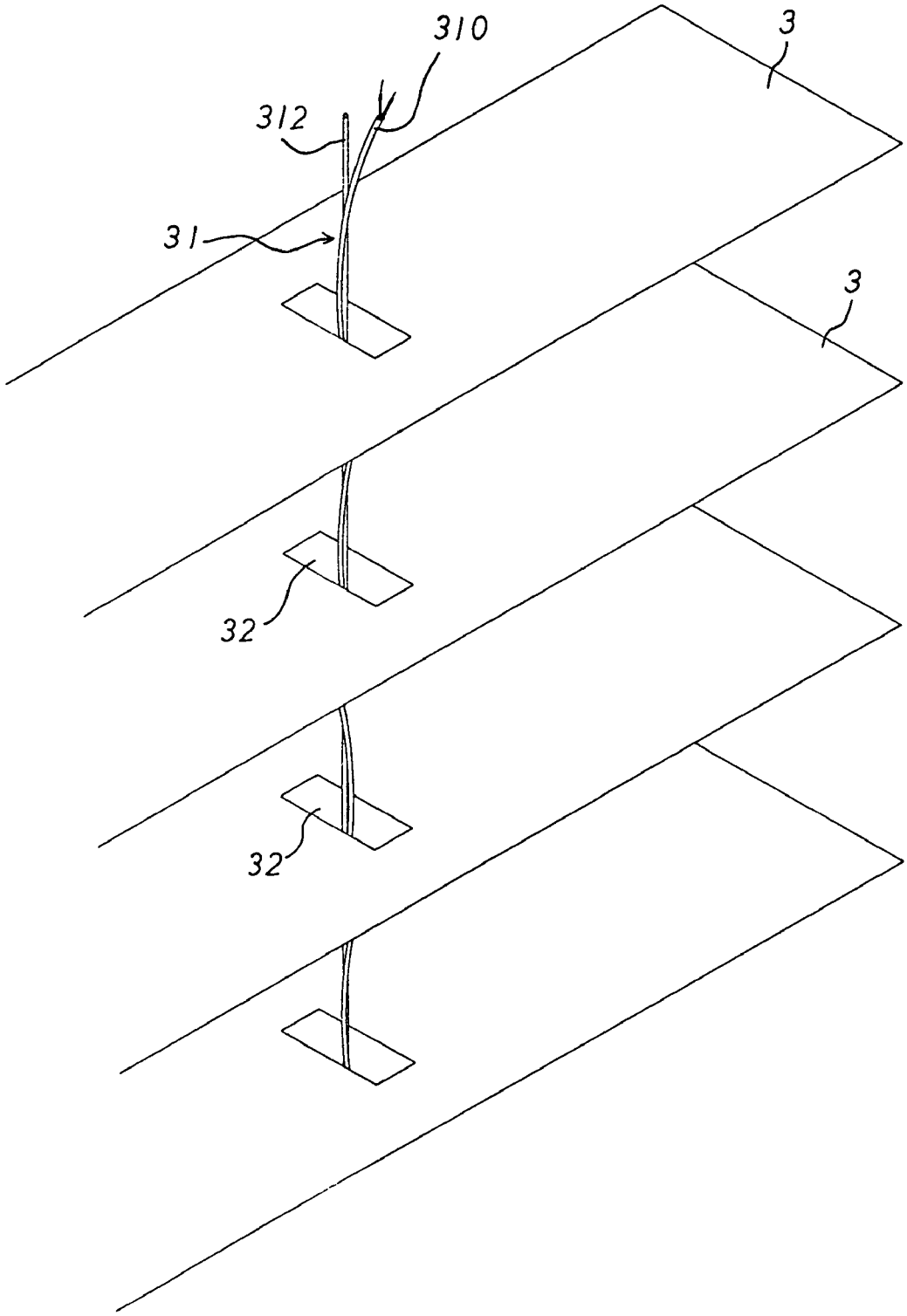
FIG. 3A is a partially perspective enlarged view of the motorized blind as shown in FIG. 1.

As shown in FIG. 3A, the conducting wire 310 of the conducting drive cord 31 is juxtaposed to the drive wire 312.

In operation, the actuating device 2 is electrically connected to the battery 22 or the chargeable battery 23 of the power supply device by the conducting drive cord 31 to drive and rotate the drive shaft 24, so that the conducting drive cord 31 and the lift cord 33 are moved by rotation of the drive shaft 24 to lift or lower the slats 3.

Figure 4:
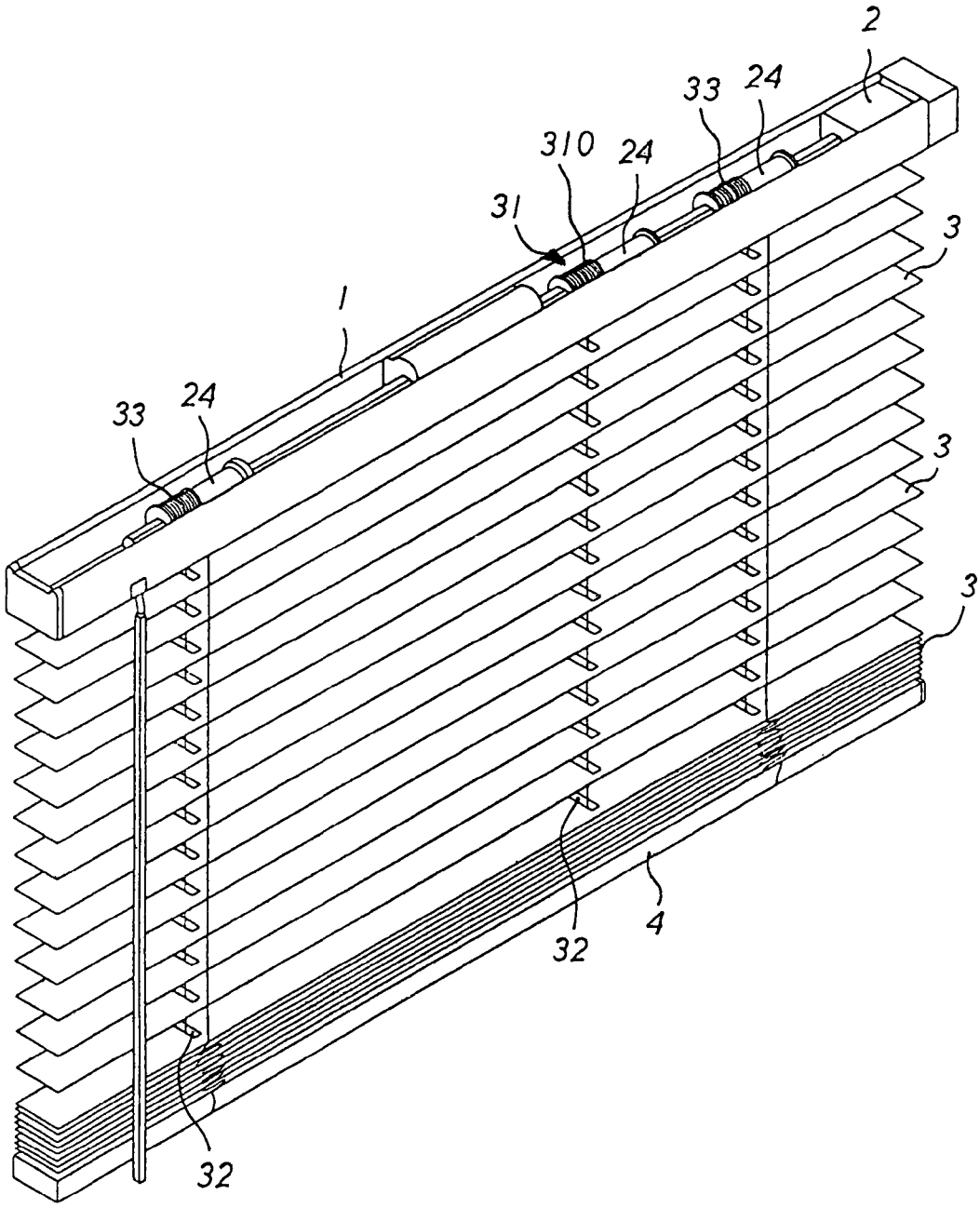
FIG. 4 is a perspective view of a motorized blind in accordance with another preferred embodiment of the present invention.

As shown in FIG. 4, the conducting drive cord 31 only includes a conducting wire 310 wound around the drive shaft 24 and electrically connected to the actuating device 2, and the motorized blind further comprises two lift cords 33 each having a first end secured to the bottom rail 4 and a second end extended through the respective through hole 32 of each of the slats 3 and wound around the drive shaft 24, so that each of the lift cords 33 is moved by rotation of the drive shaft 24 to lift or lower the slats 3.

Figure 5:
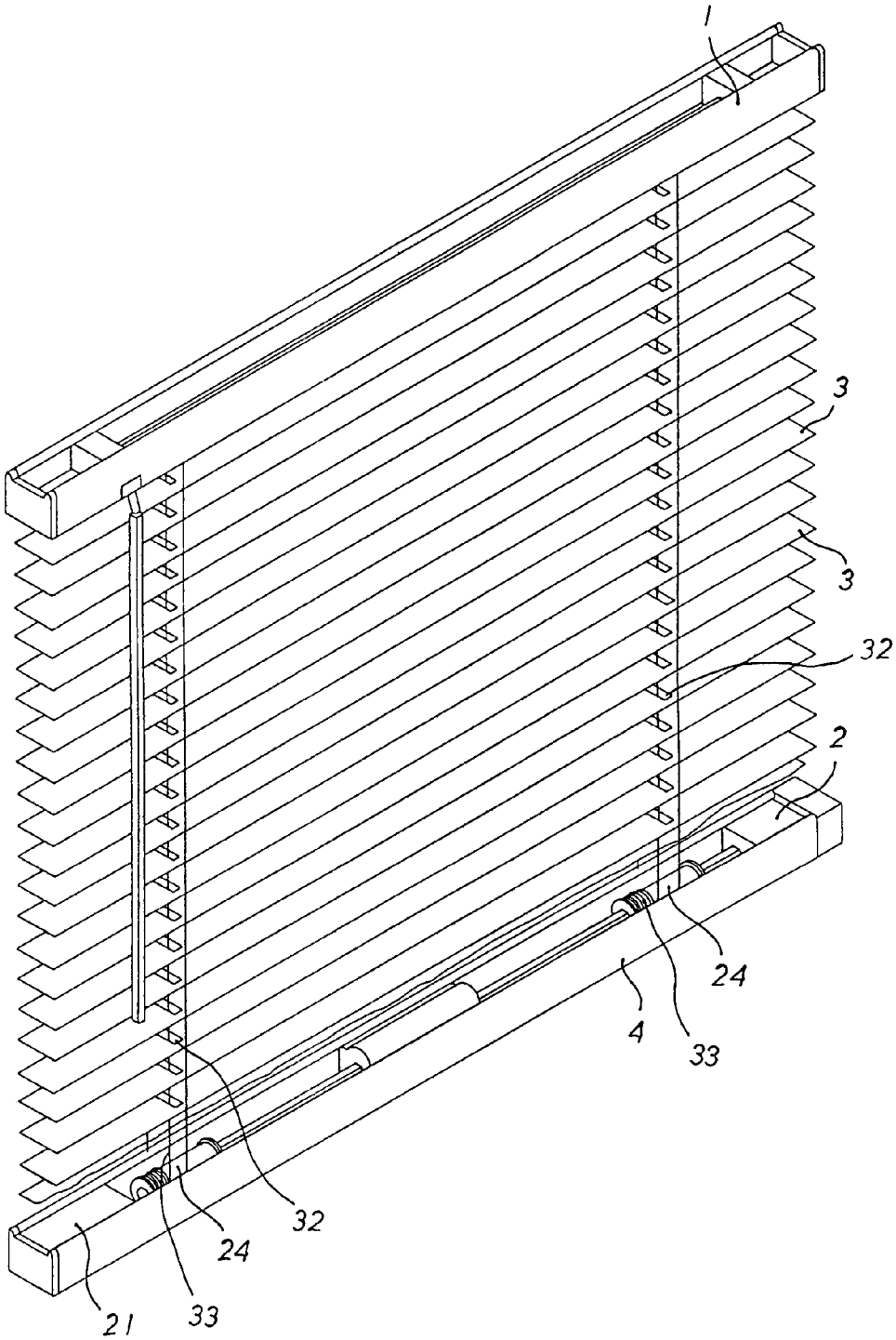
FIG. 5 is a perspective view of a motorized blind in accordance with another preferred embodiment of the present invention.
Figure 6:
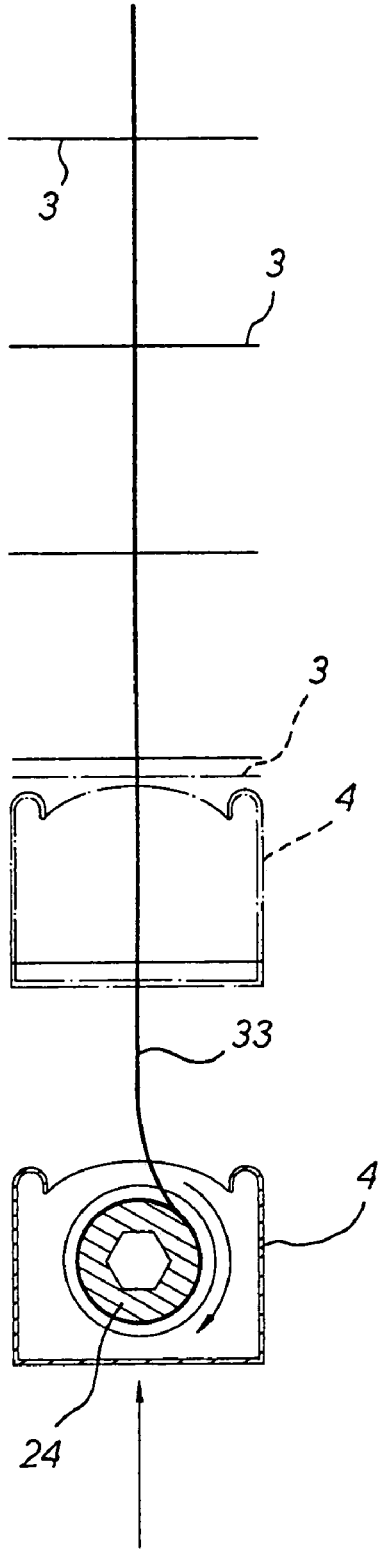
FIG. 6 is a side plan cross-sectional view of the motorized blind as shown in FIG. 5.

Referring to FIGS. 5 and 6, the drive shaft 24 is rotatably mounted in the bottom rail 4, the actuating device 2 is mounted on the bottom rail 4 to drive and rotate the drive shaft 24, and the motorized blind further comprises two lift cords 33 each having a first end secured to the headrail 1 and a second end extended through the respective through hole 32 of each of the slats 3 and wound around the drive shaft 24, so that each of the lift cords 33 is moved by rotation of the drive shaft 24 to lift or lower the slats 3. Thus, the battery 22 or the chargeable battery 23 of the power supply device mounted on the bottom rail 4 is electrically connected to the actuating device 2 to directly supply an electric power to the actuating device 2 to drive and rotate the drive shaft 24.

Accordingly, the battery 22 or the chargeable battery 23 of the power supply device is mounted in the bottom rail 4, so that the battery 22 or the chargeable battery 23 can be removed from the bottom rail 4 easily and conveniently, thereby facilitating a user replacing the battery 22 or charging the chargeable battery 23 of the power supply device when the electric power is not sufficient. In addition, both of the power supply device and the actuating device 2 mounted in the bottom rail 4, thereby facilitating maintenance of the power supply device and the actuating device 2.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A motorized blind, comprising:

a headrail;

a bottom rail;

an actuating device mounted on the headrail;

a power supply device mounted on the bottom rail and electrically connected to the actuating device to supply an electric power to the actuating device;

a plurality of slats each having a plurality of through holes;

a drive shaft rotatably mounted in the headrail and rotated by the actuating device;

wherein the power supply device includes a conducting drive cord having a distal end extended through the respective through hole of each of the slats and the drive shaft and electrically connected to the actuating device to supply the electric power to the actuating device.

2. The motorized blind in accordance with claim 1, wherein the power supply device includes a battery box mounted in the bottom rail to receive a battery.

3. The motorized blind in accordance with claim 1, wherein the power supply device includes a battery box mounted in the bottom rail to receive a chargeable battery.

4. The motorized blind in accordance with claim 1, wherein the distal end of the conducting drive cord is wound around the drive shaft, so that the conducting drive cord is moved by rotation of the drive shaft to lift or lower the slats.

5. The motorized blind in accordance with claim 4, further comprising at least one lift cord having a first end secured to the bottom rail and a second end extended through the respective through hole of each of the slats and wound around the drive shaft, so that the lift cord is moved by rotation of the drive shaft to lift or lower the slats.

6. The motorized blind in accordance with claim 5, wherein the conducting drive cord co-operates with the lift cord to lift or lower the slats.

7. The motorized blind in accordance with claim 1, wherein the conducting drive cord includes a drive wire wound around the drive shaft, and a conducting wire mounted in the drive wire and electrically connected to the actuating device.

8. The motorized blind in accordance with claim 1, wherein the conducting drive cord includes a drive wire wound around the drive shaft, and a conducting wire juxtaposed to the drive wire and electrically connected to the actuating device.

9. The motorized blind in accordance with claim 1, wherein the conducting drive cord includes a conducting wire wound around the drive shaft and electrically connected to the actuating device, and the motorized blind further comprises two lift cords each having a first end secured to the bottom rail and a second end extended through the respective through hole of each of the slats and wound around the drive shaft, so that each of the lift cords is moved by rotation of the drive shaft to lift or lower the slats.

* * * * *